US005172710A

United States Patent [19]

Harrington

[11] Patent Number: 5,172,710

[45] Date of Patent: Dec. 22, 1992

[54] APPARATUS FOR SPRAYING A LIQUID IN VESSEL

[75] Inventor: Max G. Harrington, Fair Oaks, Calif.

[73] Assignee: Sybron Chemicals Inc., Birmingham, N.J.

[21] Appl. No.: 306,400

[22] Filed: Feb. 6, 1989

[51] Int. Cl.[5] ..... B08B 3/02

[52] U.S. Cl. ..... 134/167 R; 134/181; 239/753

[58] Field of Search ..... 239/753, 264; 134/167 R, 166 R, 168 R, 172, 177, 181

[56] References Cited

U.S. PATENT DOCUMENTS

| | | | |
|---|---|---|---|
| 1,541,021 | 6/1925 | Carini | 239/753 |
| 3,444,819 | 5/1969 | Guignon | 134/167 R |
| 3,599,871 | 8/1971 | Ruppel et al. . | |
| 3,645,452 | 2/1972 | Stoeckel et al. . | |
| 3,690,730 | 9/1972 | Sakata et al. . | |
| 3,791,583 | 2/1974 | Nunlist et al. . | |
| 3,813,299 | 5/1974 | Bugor . | |
| 3,892,633 | 7/1975 | Oleszko et al. . | |
| 3,901,252 | 8/1975 | Riebe . | |
| 4,082,057 | 4/1978 | Hayes . | |
| 4,220,170 | 9/1980 | Hebert et al. . | |
| 4,244,523 | 1/1981 | Looper . | |
| 4,479,612 | 10/1984 | Umlach et al. . | |
| 4,494,737 | 1/1985 | Rymarchyk, Jr. | 239/264 |
| 4,514,443 | 4/1985 | Kostecki . | |
| 4,646,788 | 3/1987 | Tanaka et al. | 134/107 R |
| 4,662,557 | 5/1987 | Lee . | |
| 4,664,720 | 5/1987 | Rucker . | |
| 4,715,324 | 12/1987 | Muller et al. | 134/172 |
| 4,718,293 | 1/1988 | Muta . | |
| 4,798,334 | 1/1989 | Harrington . | |

*Primary Examiner*—Frankie L. Stinson
*Attorney, Agent, or Firm*—Cumpston & Shaw

[57] ABSTRACT

An apparatus for directing a liquid spray against the interior walls of a vessel from a nozzle spray means comprising a housing mounted externally to a vessel. A spray support assembly is mounted within the housing which includes a spray support assembly having a rigid fluid supply tube and a nozzle spray means mounted to the forward end of the fluid supply tube. A gear rack disposed on an outer surface the tube which extends along a predetermined length of said tube. A drive assembly mounted to the housing for engaging said gear rack and moving said tube into and out of the vessel.

7 Claims, 4 Drawing Sheets

FIG. 1

APPARATUS FOR SPRAYING A LIQUID IN VESSEL

The present invention is directed to a retractable apparatus for directing a liquid spray against the interior walls of a closed vessel.

BACKGROUND OF THE INVENTION

Large closed vessels and tanks such as those used in ships and in the brewery industry require periodic cleaning. This cleaning has generally been accomplished by providing a cleaning apparatus secured to the vessel which comprises a retractable spraying mechanism that enters the vessel through an access door. Typically, these devices are operated by a hydraulic system which is relatively expensive to manufacture, install, repair, and maintain. For effective and efficient cleaning, it is important to properly position the spray means within the vessel. With these prior art hydraulic systems it is very difficult to precisely locate the spray nozzle at a given position. Further, such devices have been limited in the positions for placement of the spray nozzle. Additionally, these type cleaning devices are designed to be used with head pressures of 150 psi or higher and in some applications a head pressure of 1000 psi or higher may be used. As a result of these high pressures, the strength and weight of such prior art devices have been increased to accomodate the forces developed. This has resulted in increased costs to manufacture.

Applicants have invented an improved cleaning apparatus that is simple in operation, reliable in performance, relatively light-weight in construction, and relative low cost to manufacture. Additionally, means are provided for accurately extending and positioning the spray means within the vessel at any desired position and which is capable of withstanding the reaction forces developed during spraying.

DETAILED DESCRIPTION OF THE INVENTION

Figure 1:
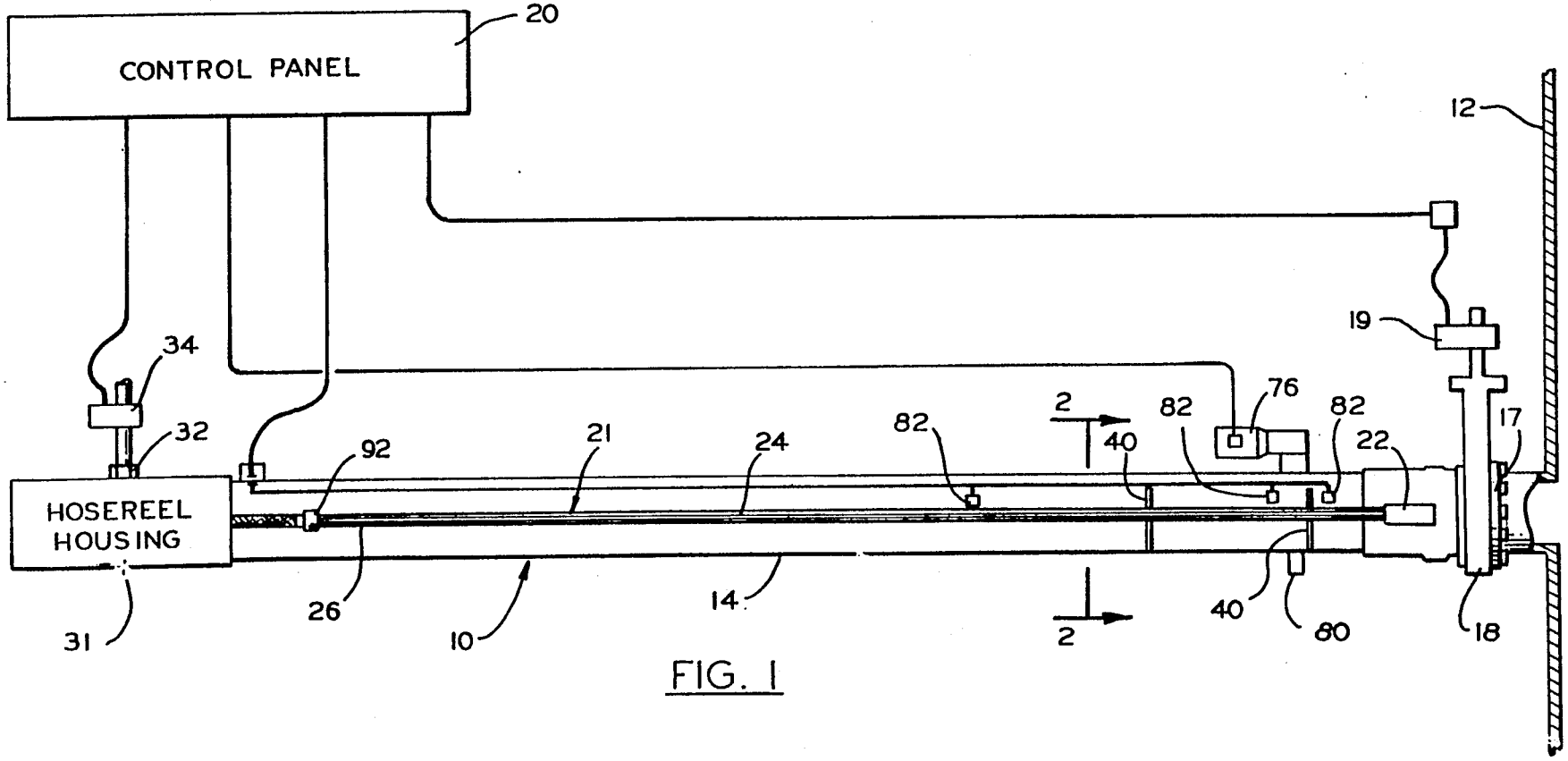
FIG. 1 is a side partial cross-sectional view and schmetic diagram of an apparatus made in accordance with the present invention as mounted to a vessel on which it is to be used.
Figure 2:
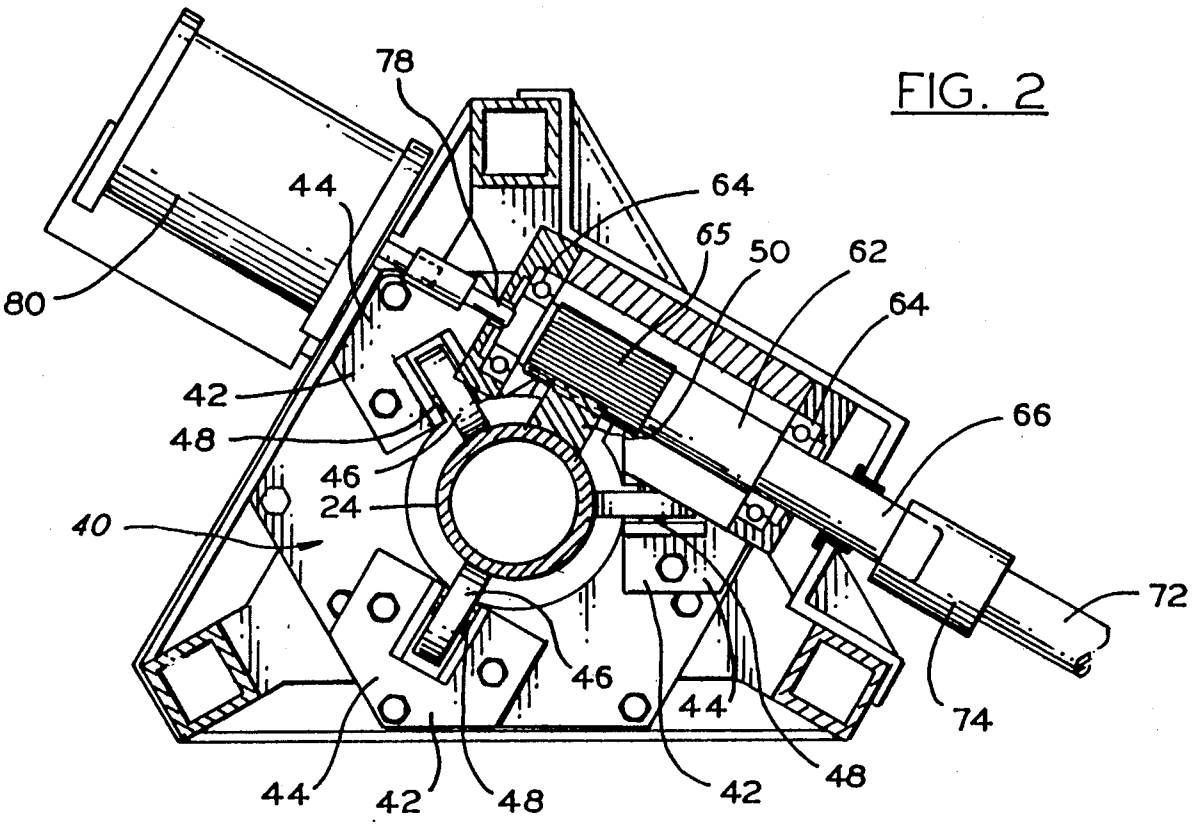
FIG. 2 is an enlarged cross-sectional view of the apparatus of FIG. 1 taken along line 2—2.
Figure 3:
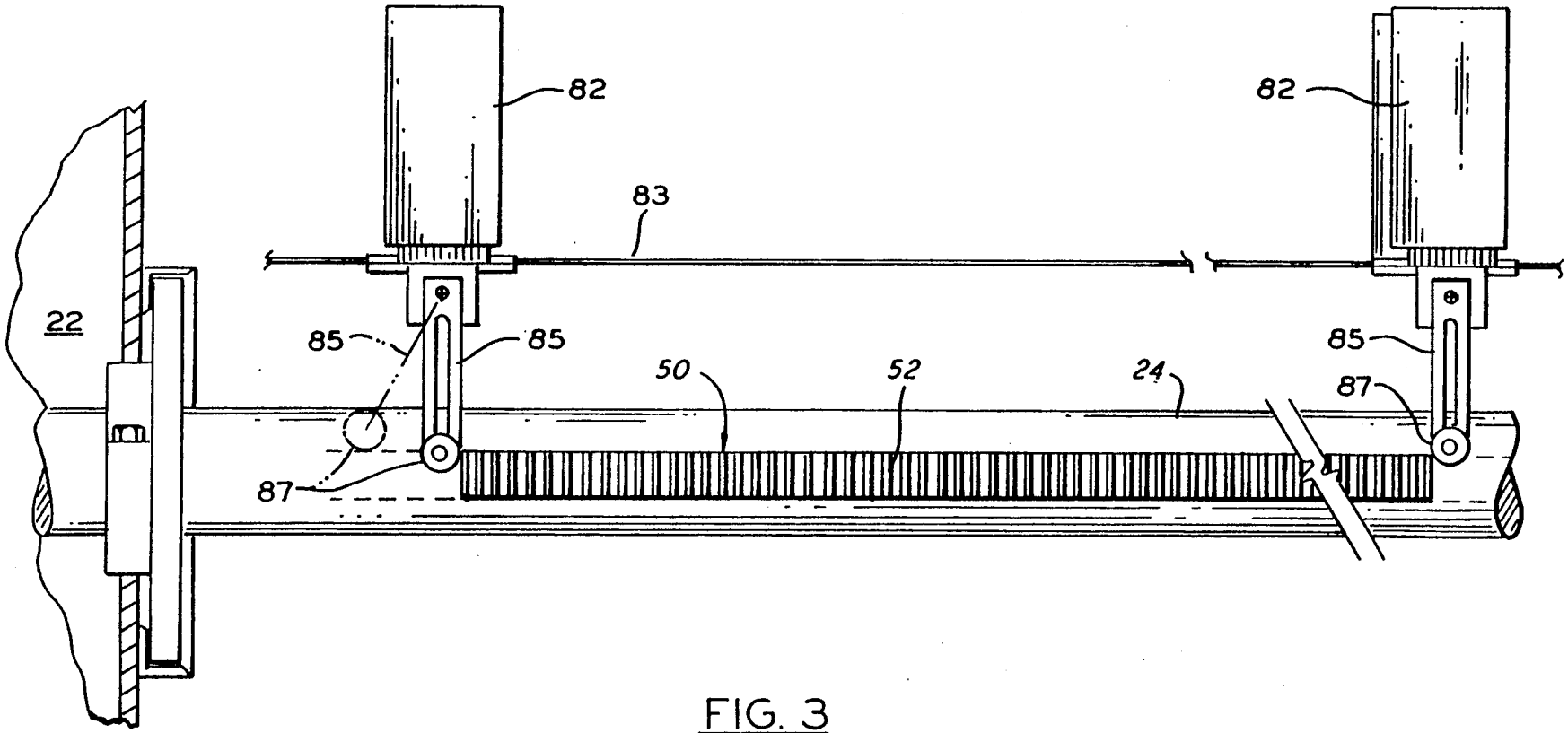
FIG. 3 is an enlarged partial side view of the cleaning assembly of the apparatus of FIG. 1.
Figure 4:
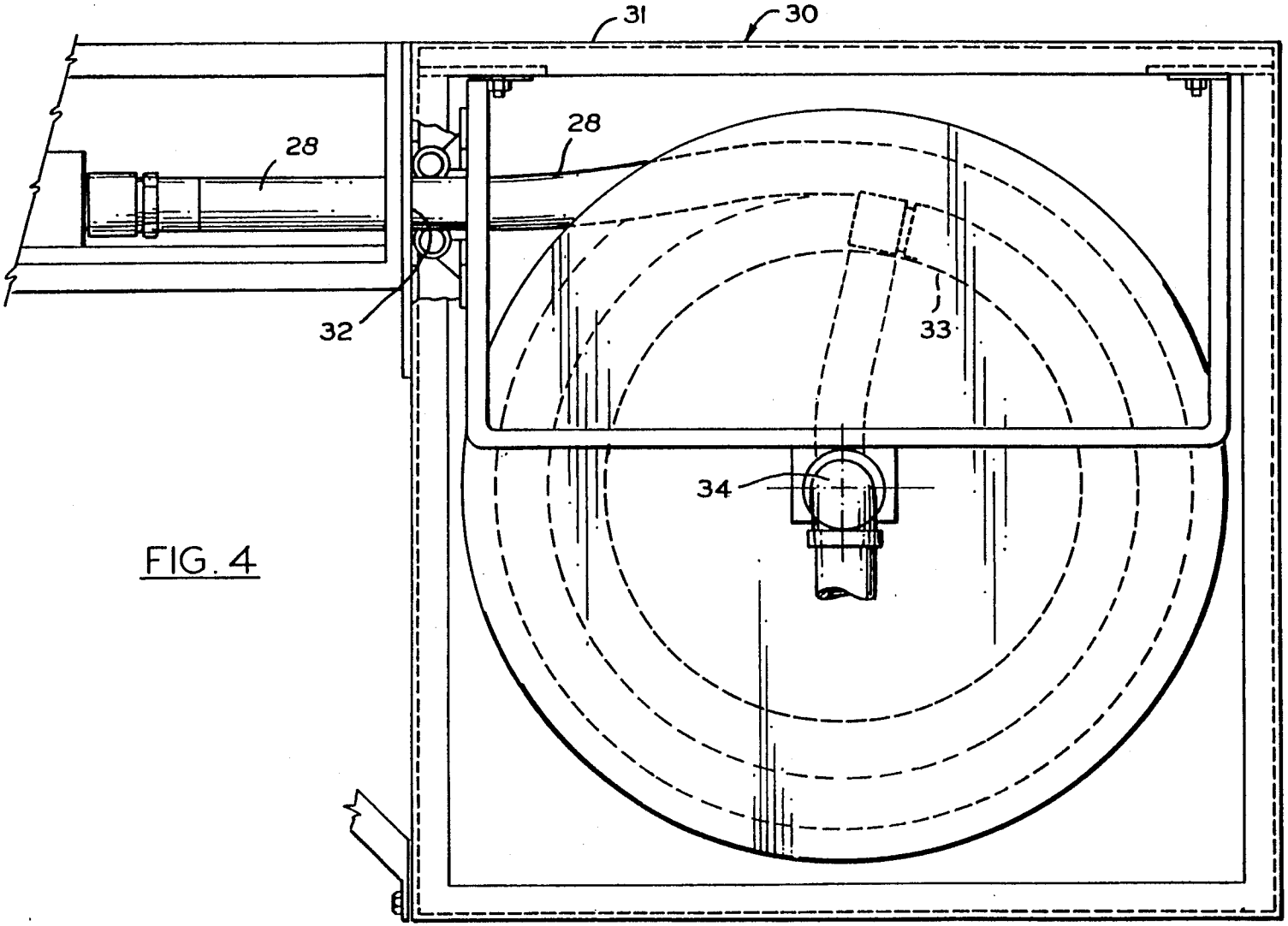
FIG. 4 is an enlarged side view of the reel housing as mounted to cleaning housing partially broken away.

Referring to FIGS. 1-3, there is illustrated a cleaning apparatus 10 made according to the present invention mounted on a closed vessel 12. Vessel 12 may be of any type used to store liquids, for example, but not by way of limitation, tanks used in the chemical processing, food, beverage, biochemical, and pharmaceutical industries. The apparatus 10 comprises a housing 14 which is mounted to vessel 12 in any desired manner as is presently done in the prior art. Apparatus 10 further includes a door assembly 18 secured to the forward end of housing 14 for sealing off the interior of vessel 12 from the interior of housing 14. In the particular embodiment illustrated, the housing 14 is mounted to vessel 12 by bolts 15 which passes through aligned openings in flange 17 and secured to door assembly 18. The door assembly 18 may be of any typical prior art design and is operated in any conventional manner. In the preferred embodiment illustrated, the access door (not shown) of door assembly 18 is operated by motor 19 which is electrically controlled by control panel 20. Preferably, as illustrated, the door preferably slides past an access opening in mounting flange 16. However, it is to be understood that any other type door assembly may be used as desired. Control panel 20 is typical of control panels of prior art devices and is capable of being programmed to provide the desired cleaning action and control and monitor the associated parts of the cleaning device. Mounted within the housing 14 is a cleaning assembly 21 which comprises a fluid supply tube 24 having its forward end fluidly connected to spray cleaning means. In the embodiment illustrated, spray cleaning means comprise a rotating nozzle 22 with controlled speed such as that sold by Sybron Chemicals, Inc. under the trademark GAMAJET. However, any desired spray means may be used.

The rearward end 26 of tube 24 is fluidly connected to a hose 28 which is stored on a supply reel assembly 30 within reel housing 31 secured to the rear end of housing 10. Reel housing 31 has an inlet 32 which allows hose 28 to pass from housing 10 to reel assembly 30. Reel assembly 30 includes a reel 33 rotably mounted within housing 31 and a hose 28 which is spirally wrapped around about reel 33. The forward end of hose 21 is fluidly connected to tube 24, while the rear end is connected to fluid outlet 34 in housing 31. A fluid control valve 35 is provided at outlet 34 to control the supply of cleaning fluid thereto. The fluid valve 35 is electrically operated and controlled by control panel 18 as is typically done in the prior art. The reel 33 is spring biased by a spring (not shown) such that when tube 24 is brought back within the housing, the reel 33 will automatically take up hose 28 on to reel 33.

Tube 24 is slideably mounted within housing 10 by support guide assemblies 40, spaced axially apart such that they support and/or guide supply tube 24 as it moves along axis x—x within housing 10 and vessel 12. In the embodiment illustrated, two support guide assemblies 40 are provided. Housing 10 in the preferred embodiment illustrated is mounted to vessel 12 in a vertical position. Accordingly, assemblies 40 primarily act to guide tube 24. However, the housing 10 may be mounted to vessel 12 in any desired orientation. When the housing 10 is mounted in the horizontal position, support assemblies 40 support and guide tube 24. Accordingly, as many asseblies 40 needed may be used. Each guide assembly 40 comprise of a plurality of roller assemblies 42, positioned about the circumference of tube 24. As illustrated in FIG. 2, three roller assemblies 42 are provided spaced equally about the circumference of supply tube 24. Each roller assembly 42 includes a support bracket 44, which is secured to housing 10. A guide roller 46 is rotably mounted to the support bracket 44 by pin 48. Pin 48 is secured to support bracket 44 by adjustable means which allows the pin 48 to be moved toward or away from tube 24 to acommodate the particular size tube 24 being used.

Mounted to the exterior of tube 24 is a gear rack 50 (see FIG. 3) having a plurality of gear teeth 52. A rack drive assembly 60 is secured to housing 10 and is designed to move gear rack 50 either into or out of the vessel 12 along its longitudinal axis x—x. The rack drive assembly 60 includes a pinion gear 62 which is rotably mounted by bearing 64 secured to housing 10. Pinion gear 62 is provided with gear teeth 65 about its circumference and are sized and shaped so as to mesh with gear teeth 52 of gear rack 50. The outer end 66 of pinion gear is connected to shaft 72 of motor 76 by coupling 74. The motor 76 is connected to control panel 20, such that it controls the operation of motor 26 and which direction of shaft 72 will rotate. The inner end 78 of pinion gear 62 is connected to encoder 80 which measures the amount of rotation of pinion gear 62. The encoder provides an appropriate signal to control panel 20. Thus, by knowing the appropriate dimensions of pinion gear 62, and the initial position of tube 24, the position of the nozzle 22 may be determined anytime by encoder 80. The motor 76 is provided with a convetional prior art brake (not shown) so as to firmly hold tube 24 in any desired position.

To prevent accidental extension of tube 24 past a predetermined point or premature operation of door assembly 18, limit switches 82 are provided which are electrically connected to control panel 20 by electrical wire 83. Limit switches 82 are designed such that they can be mechanically activated by gear rack 50 secured to tube 24 as it contacts the appropriate limit switch 82. In the particular embodiment illustrated, an arm 85 is pivoted mounted to limit switch 82. The end of arm 85 is provided with a rotatable roller 87 which follows gear rack 50. As tube 24 is moved forward, this will cause arm 85 of the forward limit switch 82 to rotate to the position illustrated in broken line which will in turn appropriately activate limit switch 82, which in turn provides an appropriate signal to control panel 20. The rearward limit switch operates in the same manner, except in the opposite direction. It is to be understood that any other type limit switch may be used as is well known in the art. Additionally, other means, such as tabs, may be used to activate the limit switches to control the desired action.

The housing 14 and reel housing 31 are preferably, as illustrated, self-contained so to minimize or prevent any vapors or cleaning solution that is present in vessel 12 from escaping to the environment. Additionally, this provides the ability to pressurize vessel 12, and housings 14, 31 at relatively low pressure to enhance the cleaning of vessel 12.

In order to more fully understand the present invention, its operation will be discussed in detail.

An operator provides the appropriate command to control panel 20. The control panel then provides the appropriate signal to door assembly 18 so as to cause the door 17 between the housing and vessel 12 to be opened. The motor 76 is then energized to rotate so as to cause pinion gear 62 to rotate in the appropriate direction which in turn causes tube 24 to extend into the vessel 12. Motor 76 is stopped at the appropriate time in response to the information previously programmed and information provided by the encoder to control panel 20. The pinion gear 16 and motor brake provides positive and secure positioning of nozzle 22 at any desired point. Thus, when spraying commences, secure positioning of nozzle 22 is provided. Furthermore, due to the positive gear drive assembly, if desired, spraying may occur as the tube 24 is being moved in or out of the vessel 12. Cleaning is accomplished by simply activating fluid control valve 34 so that the appropriate cleaning supply fluid is allowed to flow to nozzle 22. After the appropriate desired cleaning cycle has been completed, the fluid control valve is closed and the nozzle 22 retracted within the housing by activating motor 76 to turn pinion gear 16 in the opposite direction. The door 17 is then closed.

Various modifications and changes may be made without departing from the scope of the present invention. The scope of the present invention being defined by the following claims.

What is claimed is:

1. An apparatus for directing a liquid spray against the interior walls of a vessel from a nozzle spray means comprising:

a sealed housing mounted externally to said vessel;

a spray support assembly mounted within sealed housing, said spray support assembly having a rigid fluid supply tube having a forward end and a rearward end, a nozzle spray means mounted at said forward end of said fluid supply tube and fluidly connected therewith, a flexible hose fluidly connected to said rearward end of said fluid supply tube, support means for supporting said fluid supply tube and allowing said tube to move longitudinally within said sealed housing, said fluid supply tube having a gear rack disposed on its outer surface which extends along a predetermined length of said tube;

means for closing off the interior of said self-contained sealed housing from said vessel; and a drive assembly mounted to said housing for engaging said gear rack and moving said tube along said housing, said drive assembly comprising a drive gear rotatably mounted to said housing and connected to drive means.

2. An apparatus for directing a fluid spray against the interior walls of a vessel from a nozzle spray means according to claim 1 wherein said means for closing off said sealed housing from said vessel comprises a door assembly for allowing entry of said nozzle on said support assembly within said vessel.

3. An apparatus for directing a fluid spray against the interior walls of a vessel from a nozzle spray means according to claim 1 further including means for determining the position of said nozzle within said vessel, said means comprising an encoder connected to said drive assembly.

4. An apparatus according to claim 1 further comprising means for preventing accidental actuation of said motor means.

5. An apparatus according to claim 4 wherein said means for preventing accidental actuation of said motor included limits switches which are actuated in response to the position of said tube and provides a signal to said control panel.

6. An apparatus according to claim 1 further comprising a reel housing having a supply reel assembly for storing said flexible hose connected to said rigid fluid supply tube, said supply reel assembly comprising a reel rotatably mounted to said reel housing, an inlet for allowing hose to enter said reel housing and an outlet fluidly connected to the end of said hose for connection to a source of cleaning fluid, said flexible hose being spirally wrapped about said reel in the stored position.

7. An apparatus according to claim 1 wherein said support means for supporting said fluid supply tube comprises a plurality of support assemblies mounted within said housing, each of said support assemblies include a plurality of roller assemblies, each roller assembly comprising a support bracket and guide rollers rotatably mounted thereto, said guide roller supporting and guiding said tube.

* * * * *